United States Patent [19]

Vitkova et al.

[11] 4,434,030

[45] Feb. 28, 1984

[54] BATH FOR THE ELECTRODEPOSITION OF BRIGHT NICKEL IRON ALLOY

[75] Inventors: Stefana D. Vitkova; Vera V. Mircheva, both of Sofia, Bulgaria

[73] Assignee: Institute Po Physikochimia, Sofia, Bulgaria

[21] Appl. No.: 441,162

[22] Filed: Nov. 12, 1982

[51] Int. Cl.[3] ..... C25D 3/56

[52] U.S. Cl. ..... 204/43 T

[58] Field of Search ..... 204/43 T, 123

[56] References Cited

U.S. PATENT DOCUMENTS

| | | | |
|---|---|---|---|
| 3,806,429 | 4/1974 | Clauss et al. | 204/43 T X |
| 4,002,543 | 1/1977 | Clauss et al. | 204/43 T X |
| 4,134,802 | 1/1979 | Herr | 204/43 T |

*Primary Examiner*—G. L. Kaplan

[57] ABSTRACT

A bath for electrodeposition of a bright nickel-iron electrodeposit comprises conventional brighteners and complexing agents together with a novel antipitting agent comprising a hydroxyethylated oligoamide. The bath is suitable for use in electronics, the plating of jewelry, furniture and household facilities in addition to medical appliances, sporting goods, bicycle parts, motorcycles and cars.

1 Claim, No Drawings

BATH FOR THE ELECTRODEPOSITION OF BRIGHT NICKEL IRON ALLOY

This invention relates to a bath for the electrodeposition of bright nickel-iron alloy deposits. More particularly, the present invention relates to the electrodeposition of bright nickel-iron alloy deposits containing up to 30%, by weight of iron.

The known additives for bright nickel-iron alloy plating are selected from among three general categories, namely, brighteners, complexing agents and antipitting agents.

Primary brighteners, suitable for this purpose include saccharin, sulphobenzaldehyde, naphthalene trisulfonate, allyl sulfonate, aliphatic and aromatic sulfoacids, sulfonamides and sulfonimides. The secondary brighteners selected include condensation products of ethylene oxide and epichlorhydrin with acetylenic alcohols and diols such as propargyl alcohol and 1,4-butyne diol, quaternay salts containing heterocyclic nitrogen and sulfates. The secondary brighteners may also be chosen from among polyamines having a molecular weight ranging from 300–24,000, alkylate amines and sulfonated polyamines.

The electrodeposition baths known heretofore for depositing bright nickel-iron alloy coatings are capable of producing high quality alloy deposits but they contain conventional antipitting agents employed in bright nickel plating. These agents which are effective in removing pitting do not enhance other characteristics of the coating and are not suitable for the alloy plating process.

In accordance with the present invention the prior art limitation is effectively obviated by means of a novel bath for bright nickel-iron alloy coatings which bath contains an additive compatible with the brightener and stabilizer which with its antipitting action enhances the levelling power of the electrolyte and the ductibility of the coating while not adversely affecting the efficiency of the bath or causing deterioration of other properties such as internal stresses and brighteners.

The bath employed herein comprises nickel sulfate, nickel chloride, ferrous sulfate, boric acid, sodium citrate, sodium gluconate, saccharin and hydroxylated butyne-diol, the additive being a hydroxyethylated oligoamide in which the repeating unit is of the formula $$[(CH_2)_n-\underset{\underset{CH_2CH_2OH}{|}}{N}CO(CH_2)_p-\underset{\underset{CH_2CH_2OH}{|}}{N}CO]_m$$

wherein n=p n≠p and ranges from 3–12 m=4–45 there being two end radicals, in an amount of 0.1–1.5 g/l, said radicals being selected from the group consisting of $NH_2$ and COOH.

The resulting combination of the additive with conventionally employed compound yields a soft, ductile, mirror-bright, levelled nickel iron alloy coating comprising up to 30% iron. The bath evidences high corrosion resistance and no pitting or other defects. Furthermore, the additive enhances the levelling power of the electrolyte and the ductibility of the electrodeposit by from 7–10%.

The invention will be more readily understood by reference to the following exemplary embodiments which are solely for purposes of exposition and not to be construed as limiting.

EXAMPLE 1

A bright nickel-iron alloy coating was electrodeposited from a bath containing

| | |
|---|---|
| Nickel sulfate | 100 g/l |
| Nickel chloride | 70 g/l |
| Ferrous sulfate | 10 g/l |
| Boric acid | 45 g/l |
| Sodium citrate | 25 g/l |
| Saccharin | 4 g/l |
| Hydroxyethylated butyne diol | 0.2 g/l |
| hydroxyethylated oligoamide n = p = 6, M = 16 | 0.1 g/l |

The bath was maintained at a temperature of 60 degrees C. with a pH of 3.3. The cathodic current density ranged from 3–7 A/dm$^2$ with air bubbling. The resultant electrodeposits were mirror bright with low internal stresses, high ductility and highly levelled.

EXAMPLE 2

The bath employed for depositing bright nickel-iron alloy coatings in accordance with the procedure of example 1 included

| | |
|---|---|
| Nickel sulfate | 100 g/l |
| Nickel chloride | 70 g/l |
| Ferrous sulfate | 10 g/l |
| Boric acid | 45 g/l |
| Sodium citrate | 12.5 g/l |
| Sodium gluconate | 12.5 g/l |
| Saccharin | 4.0 g/l |
| Hydroxyethylated butyne diol | 0.2 g/l |
| Hydroxyethylated oligoamide n = p = 6, m = 20 | 0.15 g/l |

The levelling was found to be slightly higher than that attained in example 1.

EXAMPLE 3

An electrodeposition bath for preparing protective decorative nickel-iron alloy coatings included

| | |
|---|---|
| Nickel sulfate | 113.2 g/l |
| Nickel chloride | 117.2 g/l |
| Ferrous sulfate | 4.5 g/l |
| Boric acid | 50.0 g/l |
| Sodium citrate | 10.0 g/l |
| Sodium gluconate | 10.0 g/l |
| Saccharin | 4.0 g/l |
| Hydroxyethylated butyne diol | 0.4 g/l |
| Hydroxyethylated oligoamide n = 4, p = 6, m = 30 | 0.25 g/l |

The temperature of the bath was 55 degrees C. and the pH 3.5. The current density was 1 A/dm$^2$ with cathode agitation. The resultant coatings were soft with high ductility, mirror brightness and higher levelling than obtained with the coatings of examples 1 and 2.

The described bath may be used to replace those employed in all yields of coating such as electronics, jewelry, furniture, medical appliances, sporting goods, bicycle parts, motorcycles and cars.

We claim:

1. Bath for electrodeposition of a bright nickel-iron electrodeposit which comprises nickel sulfate, nickel chloride, ferrous sulfate, boric acid, sodium citrate, sodium gluconate, saccharin and hydroxylated butyne diol characterized in that said bath includes an antipitting agent which is a hydroxyethylated oligoamide with the repeating unit $$[(CH_2)_n-\underset{\underset{CH_2CH_2OH}{|}}{N}CO(CH_2)_p-\underset{\underset{CH_2CH_2OH}{|}}{N}CO]_m$$

wherein $n=p$ $n\neq p$ n and p range from 3–12 m ranges from 4–45 there being two end radicals, in an amount of 0.1–1.5 g/l, said radicals being selected from the group consisting of $NH_2$ and COOH.

* * * * *